US007750228B2

(12) United States Patent
Fujishima et al.

(10) Patent No.: US 7,750,228 B2
(45) Date of Patent: Jul. 6, 2010

(54) TONE PROCESSING APPARATUS AND METHOD

(75) Inventors: Takuya Fujishima, Hamamatsu (JP); Jordi Bonada, Barcelona (ES); Maarten De Boer, Barcelona (ES)

(73) Assignee: Yamaha Corporation, Hamamatsu-shi (JP)

( * ) Notice: Subject to any disclaimer, the term of this patent is extended or adjusted under 35 U.S.C. 154(b) by 130 days.

(21) Appl. No.: 12/006,918

(22) Filed: Jan. 7, 2008

(65) Prior Publication Data

US 2008/0236364 A1 Oct. 2, 2008

(30) Foreign Application Priority Data

Jan. 9, 2007 (JP) ..... 2007-001058

(51) Int. Cl.
*G10H 1/00* (2006.01)
*G10H 1/18* (2006.01)

(52) U.S. Cl. ..... 84/615; 84/618; 84/653; 84/656

(58) Field of Classification Search ..... None
See application file for complete search history.

(56) References Cited

U.S. PATENT DOCUMENTS

| | | | | |
|---|---|---|---|---|
| 5,018,430 | A | 5/1991 | Iijima et al. | |
| 5,536,902 | A | 7/1996 | Serra et al. | |
| 6,506,969 | B1 * | 1/2003 | Baron | 84/609 |
| 2003/0159568 | A1 | 8/2003 | Kemmochi et al. | |
| 2006/0015344 | A1 | 1/2006 | Kemmochi | |
| 2006/0074649 | A1 * | 4/2006 | Pachet et al. | 704/229 |

FOREIGN PATENT DOCUMENTS

| | | | |
|---|---|---|---|
| DE | 10 2004 050 368 | A1 | 4/2006 |
| EP | 1 220 195 | A2 | 7/2002 |
| EP | 1 455 340 | A1 | 9/2004 |
| EP | 1646035 | A1 | 4/2006 |
| EP | 1 791 111 | A1 | 5/2007 |

(Continued)

OTHER PUBLICATIONS

Japanese Patent Office: Office Action, "Notice of Grounds for Rejection" for Patent Application No. 2007-001058, dated Oct. 21, 2008, (10 pgs.).

(Continued)

*Primary Examiner*—Marlon T Fletcher
(74) *Attorney, Agent, or Firm*—Pillsbury Winthrop Shaw Pittman LLP

(57) ABSTRACT

For at least one music piece, a storage section stores tone data of each of a plurality of fragments segmented from the music piece and stores a first descriptor indicative of a musical character of each of the fragments in association with the fragment. Descriptor generation section receives input data based on operation by a user and generates a second descriptor, indicative of a musical character, on the basis of the received input data. Determination section determines similarity between the second descriptor and the first descriptor of each of the fragments. Selection section selects the tone data of at least one fragment on the basis of a result of the similarity determination by the determination section. On the basis of the tone data of the selected at least one fragment, a data generation section generates tone data to be outputted.

20 Claims, 3 Drawing Sheets

FOREIGN PATENT DOCUMENTS

| | | | |
|---|---|---|---|
| EP | 1 804 235 | A1 | 7/2007 |
| JP | 2002-123287 | | 4/2002 |
| JP | 2006084749 | A | 3/2006 |
| JP | 2006-106754 | | 4/2006 |
| WO | WO 2006/030612 | A1 | 3/2006 |
| WO | WO 2006/043536 | A1 | 4/2006 |

OTHER PUBLICATIONS

European Patent Office: Extended European Search Report; Patent Application No. 08100049.9-2225, dated: Oct. 22, 2008; 19 pgs.).

Jordi Bonada and Xavier Serra: Synthesis of the Singing Voice by Performance Sampling and Spectral Models, dated Mar. 2007 (13 pgs.).

Jordi Bonada: Audio Engineering Society, Convention Paper 6362: Voice Solo to Unison Choir Transformation, dated May 28-31, 2005 (XP009068509) (4 pgs.).

Paul Rubens: Virtual Voices, dated Feb. 19, 2004 (XP-002497626) (1 pg.).

Bill Werde: Music; Could I Get That Song in Elvis, Please?, dated Nov. 23, 2003 (XP-002497627) (2 pgs).

European Patent Office: Partial European Search Report/Lack of Unitity of Invention; Patent Application No. EP 08 10 0049, dated: May 13, 2008; 9 pgs).

* cited by examiner

TONE PROCESSING APPARATUS AND METHOD

BACKGROUND

The present invention relates to techniques for selectively using a plurality of pre-recorded tone data to generate a tone.

Heretofore, there have been proposed techniques for selectively outputting any one of a plurality of tone data in response to operation of an operator member (e.g., key) of an electronic musical instrument. Japanese Patent Application Laid-open Publication No. 2006-106754 (corresponding to European Patent Application Publication No. EP 1646035), for example, discloses a system where is defined in advance correspondence relationship (or mapping) between tone data of individual sections of music pieces and operator members of an electronic musical instrument. Once a user of the disclosed system operates a particular one of the operator members, tone data corresponding to the operated operator member is reproduced.

However, with the technique disclosed in the No. 2006-106754 publication, it is necessary to perform in advance a huge number of processes in order to define relationship between various inputs to the electronic musical instrument and many tone data. Particularly, because a sufficient number of tone data have to be secured in order to diversify tones to be generated in response to operation by the user, the foregoing problem would become very serious.

SUMMARY OF THE INVENTION

In view of the foregoing, it is an object of the present invention to reduce a load involved in defining relationship between inputs and relationship between various inputs and many tone data.

In order to accomplish the above-mentioned object, the present invention provides an improved tone processing apparatus, which comprises: a storage section that, for at least one music piece, stores tone data of each of a plurality of fragments segmented from the music piece and stores a first descriptor indicative of a musical character of each of the fragments in association with the fragment; a descriptor generation section that receives input data based on operation by a user and generates a second descriptor, indicative of a musical character, on the basis of the received input data; a determination section that determines similarity between the second descriptor and the first descriptor of each of the fragments; a selection section that selects the tone data of at least one of the fragments from the storage section on the basis of a result of similarity determination by the determination section; and a data generation section that, on the basis of the tone data of the fragment selected by the selection section, generates tone data to be output.

With the arrangement that a second descriptor is generated on the basis of input data based on user's operation and tone data of an appropriate fragment is selected from the storage section in accordance with the determined similarity of the first descriptor of each of the fragments to the second descriptor, the present invention can eliminate the need for defining in advance relationship (or mapping) between input data and first descriptors stored in the storage section; thus, the cumbersome advance definition (mapping) processing can be dispensed with. Besides, because tone data to be output is generated on the basis of the tone data of the thus-selected fragment, the present invention can generate tone data appropriately reflecting therein an intension of the user.

In an embodiment, the determination section calculates a similarity index value indicative of a degree of similarity, to the second descriptor, of the first descriptor of each of the fragments, and the selection section selects, from the storage section, the tone data of at least one of the fragments on the basis of the similarity index value calculated by the determination section. With such an arrangement, the similarity determination result is quantified as a similarity index value indicative of a degree of the first descriptor of each of the fragments, and thus, the selection process based on the similarity determination result can be facilitated.

In an embodiment, the descriptor generation section receives input data from a performance device that generates the input data in response to performance operation by the user. With such an arrangement, the present invention can generate tone data reflecting therein real-time performance operation by the user.

In the present invention, each "fragment" is one of a plurality of sections or segments obtained by dividing (i.e., divided from) a music piece. In a more preferred implementation, each fragment is one of segments obtained by dividing a music pieces every one or a predetermined number of beats, or one of segments obtained by dividing an interval between successive beat points (e.g., segment of a time length corresponding to a ½ or ¼ beat). Using such fragments synchronous with beat points of a music piece, the present invention can generate tones with a natural rhythm feeling.

In the present invention, specific content of the first and second descriptors may be chosen as desired, and the following are examples of forms of the first and second descriptors that may be used in the invention.

For example, the first descriptor may include a combination of information indicative of a pitch of a tone included in the fragment associated therewith and information indicative of a volume of the tone (e.g., HPCP (Harmonic Pitch Class Profile) and LPF-HPCP in FIG. 2 that will be described later). In this case, the input data includes operator data (e.g., note number) indicative of a performance operator member operated by the user on the performance device and intensity data (e.g., velocity) indicative of intensity of operation, by the user, of the performance operator member, and the descriptor generation section generates the second descriptor that includes a combination of information indicative of a pitch corresponding to the operator data and information indicative of a volume corresponding to the intensity data. Here, a fragment with the first descriptor including a combination of a tone pitch and volume which is similar to a combination of a tone pitch and volume designated by the user through operation on the performance device is selected for generation of the tone data to be output.

The first descriptor may include information indicative of a volume of a tone included in the fragment associated therewith. In this case, the input data includes intensity data indicative of intensity of operation, by the user, of a performance operator member of the performance device, and the descriptor generation section generates the second descriptor that includes information indicative of a volume corresponding to the intensity data. Here, a fragment with the first descriptor including a tone volume similar to a tone volume designated by the user through intensity of operation on the performance device, for example, is selected for generation of the tone data to be output.

Further, the first descriptor may include information indicative of a spectral center of gravity of a chord included in the fragment associated therewith. In this case, the descriptor generation section determines a chord on the basis of the input data, determines a spectral center of gravity of the determined chord and generates the second descriptor including information indicative of the determined spectral center of gravity of the determined chord. Here, a fragment with the first descriptor including a spectral center of gravity of a chord similar to a spectral center of gravity of a desired chord designated by the user using input data, for example, is selected for generation of the tone data to be output.

Further, the first descriptor may include information indicative of a degree of variation of a tone within the fragment associated therewith. In this case, the input data includes after-touch data indicative of a sustained operating state of a performance operator member of the performance device following operational triggering, by the user, of the performance operator member, and the descriptor generation section generates the second descriptor that includes degree-of-variation information corresponding to the after-touch data. Here, a fragment with the first descriptor including degree-of-variation information which is similar to a degree of variation in a sustained operating state following operational triggering (i.e., degree of variation of after-touch data), for example, is selected for generation of the tone data to be output.

Furthermore, the first descriptor may include information indicative of a tempo in the fragment associated therewith. In this case, the input data includes beat point data indicative of a beat point synchronous with an input motion of the user, and the descriptor generation section generates the second descriptor that includes information indicative of a tempo corresponding to the beat point indicated by the beat point data. Here, a fragment with the first descriptor including a tempo similar to a tempo designated by the user through input operation, for example, is selected for generation of the tone data to be output.

In a preferred embodiment of the present invention, the input data includes beat point data indicative of a beat point synchronous with an input motion of the user, and the data generation section includes a connecting section that time-serially arranges the tone data of the fragments, sequentially selected by the selection section, in such a manner that the tone data synchronizes with the beat point indicated by the beat point data. Because the tone data to be output is generated by time-serially arranging the tone data of each of the fragments in such a manner that the tone data synchronizes with the beat point indicated by the beat point data, the user can advantageously control a tone tempo of the tone data to be output. In a case where the tone data time length differs among the fragments, the data generation section preferably further includes a processing section that processes a respective time length of the tone data of each of the fragments, sequentially selected by the selection section, in such a manner that the tone data has a time length corresponding to a time interval between the beat points indicated by the beat point data. With this arrangement, the present invention can achieve generation of natural tones where tones of individual fragments are smoothly interconnected.

In a preferred embodiment, the first descriptor and the second descriptor each include a character value of each of a plurality of types of musical character elements, and the tone processing apparatus further comprises a setting section that sets weighting, as desired by the user, individually for each of the plurality of types of musical character elements, the determination section using a character value, weighted for each of the musical character elements, to determine similarity between the second descriptor and the first descriptor of each of the musical character elements. Because the similarity is determined after the individual character values are weighted independently of each other, the present invention can select fragments with similarity of a particular character value given priority consideration.

The present invention may be constructed and implemented not only as the apparatus invention as discussed above but also as a method invention. Also, the present invention may be arranged and implemented as a software program for execution by a processor such as a computer or DSP, as well as a storage medium storing such a software program. Further, the processor used in the present invention may comprise a dedicated processor with dedicated logic built in hardware, not to mention a computer or other general-purpose type processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which.

DETAILED DESCRIPTION

A. Construction of Tone Processing Apparatus

Figure 1:
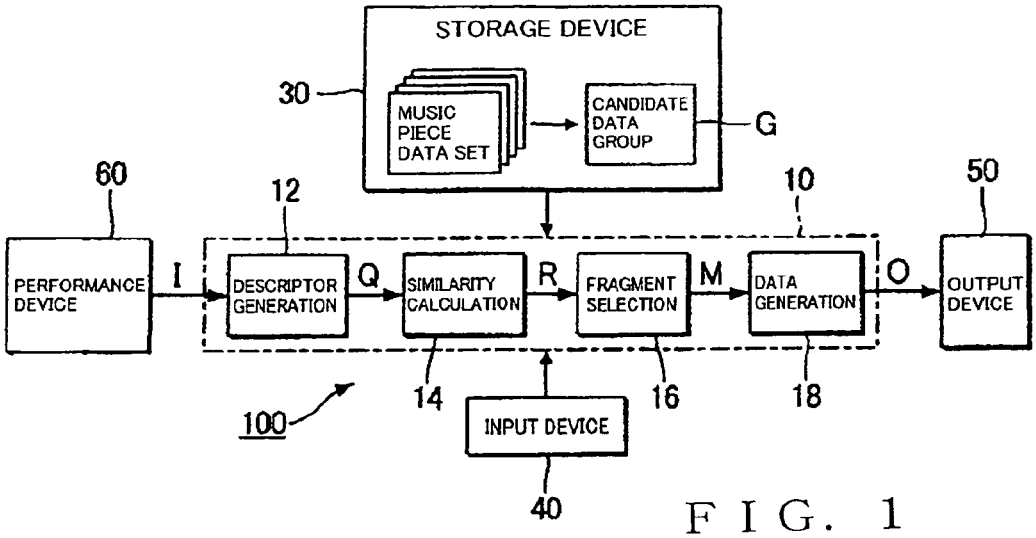
FIG. 1 is a block diagram showing an example general setup of a tone processing apparatus in accordance with an embodiment of the present invention.

FIG. 1 is a block diagram showing an example general setup of a tone processing apparatus in accordance with an embodiment of the present invention. As shown, the tone processing apparatus 100 is implemented by a computer system which comprises a control device 10, a storage device 30, an input device 40 and an output device 50. Performance device 60 is connected to the control device 10.

The control device 10 is an arithmetic processing unit (CPU) that controls various sections of the tone processing apparatus 100 by executing programs. The storage device 30 stores a program to be executed by the control device 10 and various data to be used for processing by the control device 10. Any of a semiconductor storage device, magnetic storage device and optical storage device, for example, is suitably used as the storage device 30. The storage device 30 stores one or more music piece data sets of one or more music pieces.

Each music piece is segmented into a plurality of sections or segments (hereinafter referred to as "fragments") with time points synchronous with beat points used as dividing boundaries. In the instant embodiment, the fragment is a section of a time length corresponding to one beat of a music piece. In the case of a quadruple-time music piece, for example, each segment obtained by dividing a measure of the music piece into four equal sections is set as a "fragment". Alternatively, each segment obtained by dividing a beat of a music piece (e.g., each segment of a time length corresponding to a ½ or ¼ beat) may be set as a "fragment". In another alternative, each segment obtained by segmenting a music piece independently of the beat (e.g., each segment of a fixed time length unrelated to the beat) or each segment of a predetermined time length from a sounding start point of a tone (e.g., high-volume tone, such as a drum tone) may be set as a "fragment".

Figure 2:
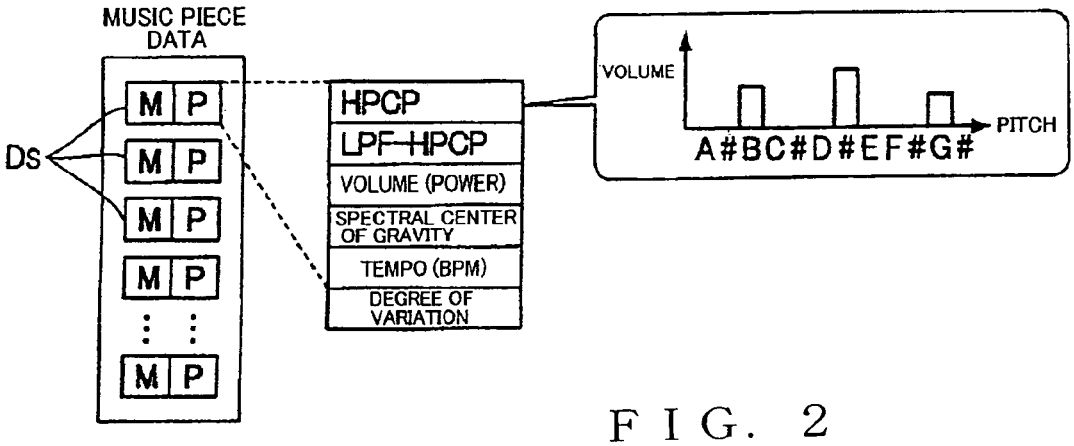
FIG. 2 is a conceptual diagram showing an example structure of music piece data.

FIG. 2 is a conceptual diagram showing an example structure of music piece data. As shown, a music piece data set of a music piece includes respective fragment data $D_S$ of a plurality of fragments obtained by dividing the music piece. The music piece data set may include either fragment data $D_S$ of all of the fragments of the music piece or fragment data $D_S$ of only fragments belonging to a particular section (e.g., "bridge" section) of the music piece. As seen in FIG. 2, the fragment data $D_S$ of each fragment includes tone data M indicative of a waveform of a tone included in the fragment, and a descriptor (first descriptor) P indicative of a musical character of the tone. Namely, each music piece data set comprises tone data M of the individual fragments, and first descriptors P associated with the fragments.

In the instant embodiment, the descriptor (first descriptor) P comprises respective character values of a plurality of types of character elements, including HPCP (Harmonic Pitch Class Profile), LPF (Low Pass Filter)-HPCP, volume (average energy value) of a tone within the fragment, spectral center of gravity, tempo, degree of variation, etc.

As shown in FIG. 2, the HPCP is a character value indicative of a combination of a pitch and volume of one tone or each of a plurality of tones (i.e., chord) included in the fragment. The LPF-HPCP is an HPCP of a tone below a predetermined frequency among tones included in the fragment. The spectral center of gravity (spectral centroid) is a frequency corresponding to a gravity of center of a frequency spectrum of a tone (particularly a chord) included in the fragment. The tempo is defined as the number of beat points within a unit time (BPM: Beat Per Minute). The degree of variation is a character value indicative of a degree with which a tone varies in the fragment. Namely, the degree of variation is a character element that increases in value as the number of the tone included in the fragment increases or as the number of times the tone pitch changes in the fragment increases; in other words, the degree of variation is low when the tone is stable in the fragment.

The input device 40 shown in FIG. 1 is equipment, such as a mouse and keyboard, operable by a user to input various instructions to the tone processing device 100. The performance device 60 is an input device that generates data I (hereinafter referred to as "input data I") corresponding to content of a performance by the user. The control device 10 generates output data O by selectively using the fragment data $D_S$ of a fragment, corresponding to the input data I, from among a plurality of music piece data sets stored in the storage device 30. The output device 50 audibly generates a tone on the basis of the output data O output from the control device 10. The output device 50 includes, for example, a D/A converter that generates an analog signal from the output data O, an amplifier that amplifies the analog signal output from the D/A converter, and sounding equipment, such as a speaker or headphone, that outputs a sound wave corresponding to the signal output from the amplifier.

The control device 10 generates output data O using a group of a plurality of fragment data $D_S$ (hereinafter referred to as "candidate data group G") extracted in advance from a plurality of music piece data sets stored in the storage device 30. One or more conditions with which fragment data $D_S$ are selected as a candidate data group G are determined in accordance with operation performed by the user on the input device 40. For example, as the user designates a particular character value by operating the input device 40, the control device 10 selects, as a candidate data group G, a plurality of fragment data $D_S$ of which the particular character value in the descriptor P is above a predetermined value. As an example, bibliographic data, such as a genre and name of a singer, may be added in advance to each music piece data set stored in the storage device 30 so that the control device 10 can select, as a candidate data group G, only fragment data $D_S$ of a music piece matching bibliographic data designated or input by the user via the input device 40.

Figure 3:
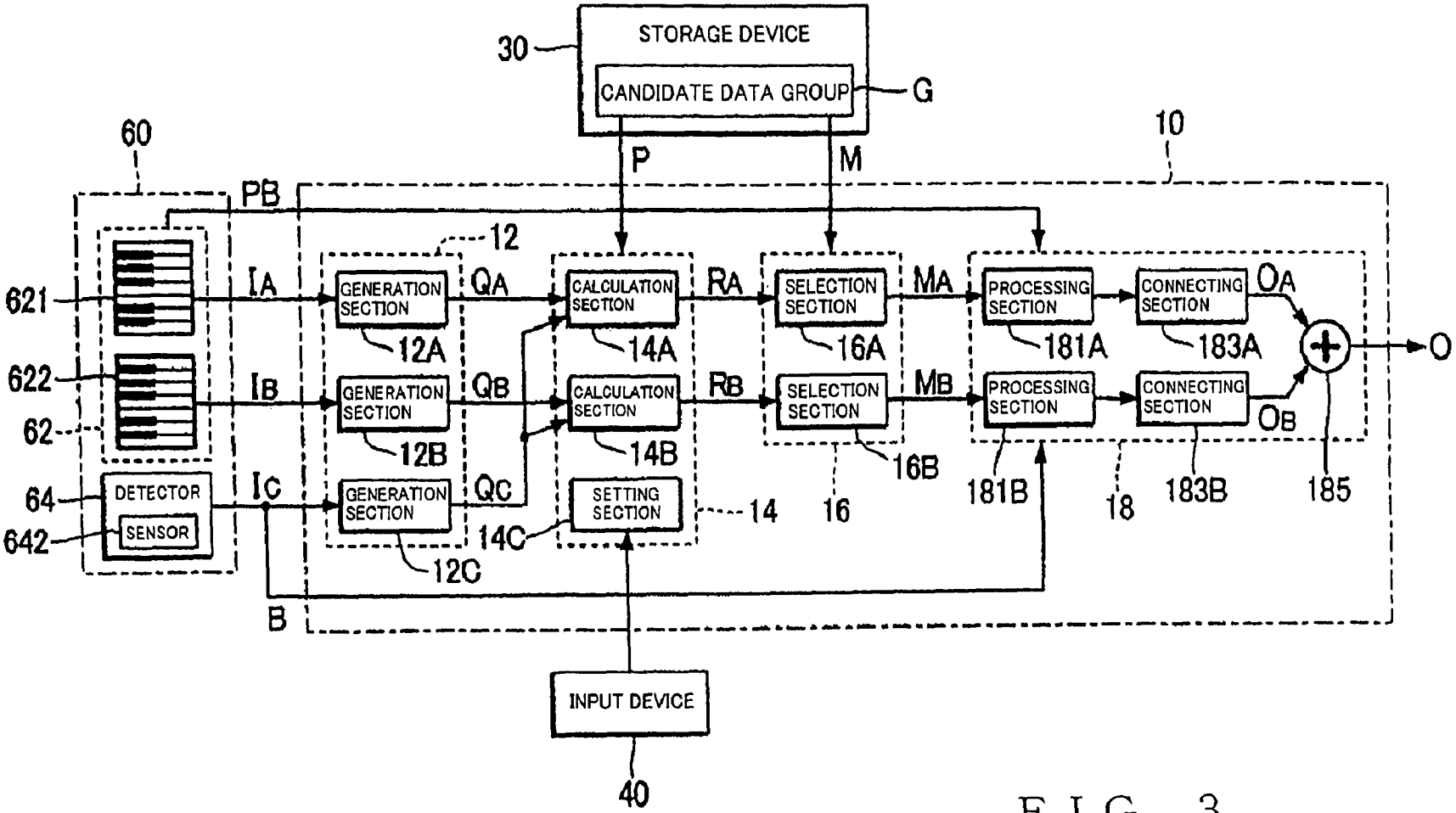
FIG. 3 is a block diagram showing example detailed functional constructions of a performance device and control device.

FIG. 3 is a block diagram showing example detailed constructions of the performance device 60 and control device 10. The performance device 60 includes an electronic musical instrument 62 and a detector 64. The electronic musical instrument 62 is a keyboard having a plurality of keys (operator members) to be depressed by the user, which outputs in real time input data I ($I_A$, $I_B$), compliant with the MIDI (Musical Instrument Digital Instrument) standard, in response to performance operation thereon by the user. As shown in the figure, the electronic musical instrument 62 is divided into a higher-pitch section 621 and lower-pitch section 622 with a predetermined tone pitch used as a dividing boundary point. The electronic musical instrument 62 generates input data $I_A$ in response to user's operation of a key belonging to the higher-pitch section 621 and generates input data $I_B$ in response to user's operation of a key belonging to the lower-pitch section 621. Further, the electronic musical instrument 62 outputs pitch-bend data PB, designating tone pitch variation, in response to user's operation. Note that a specific form of the electronic musical instrument 62 may be chosen as desired; for example, the electronic musical instrument 62 may be of a string instrument type.

Figure 4:
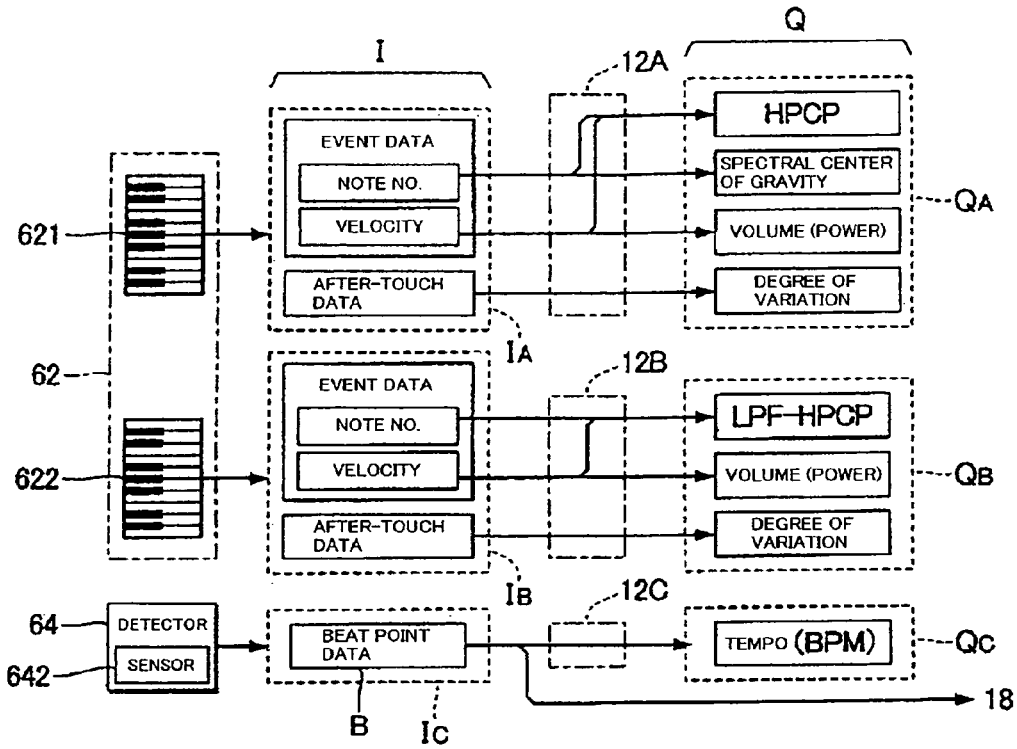
FIG. 4 is a conceptual diagram showing relationship between input data and descriptors.

FIG. 4 is a conceptual diagram showing details of input data I ($I_A$, $I_B$, $I_C$) generated by the performance device 60. As shown, the input data $I_A$ and $I_B$ are each event data instructing tone generation start or tone generation end (tone deadening), or after-touch data indicative of a sustained operating (or depressing) state after key depression (i.e., key-on triggering) by the user. The event data includes data of a note number indicative of a pitch of a tone corresponding to a key of the instrument 62 having been operated by the user, and data of velocity indicative of intensity of the key depression (key-on triggering). The after-touch data includes pressure data designating depression pressure (channel pressure or polyphonic key pressure) after the key depression (key-on triggering).

The detector 64 shown in FIGS. 3 and 4 includes a sensor (e.g., acceleration sensor) 642 that detects a motion of the user. The detector 64 outputs beat point data B (input data $I_C$) designating, as a beat point, a time point synchronous with the motion detected via the sensor 642. For example, the beat point data B designates, as a beat point, a time point at which the acceleration detected by the sensor 642 reaches a maximum value. Further, once the motion of the user stops, the detector 64 keeps continuously outputting beat point data B designating, as a beat point, a time point synchronous with the user's motion detected immediately before the stop.

As shown in FIG. 1, the control device 10 can operate as a plurality of functioning members (e.g., descriptor generation section 12, similarity calculation section 14, fragment selection section 16 and data generation section 18) each of which performs separate or independent processing. As shown in FIGS. 1 and 3, the descriptor generation section 12 generates a second descriptor Q ($Q_A$, $Q_B$, $Q_C$) on the basis of input data I ($I_A$, $I_B$, $I_C$) supplied from the performance device 60. The second descriptor Q describes a musical character of a performance, executed by the user on the performance device 60, in a similar manner to the aforementioned first descriptor P.

As shown in FIG. 3, the second descriptor generation section 12 includes generation sections $\mathbf{12}_A$, $\mathbf{12}_B$ and $\mathbf{12}_C$. The generation sections 12A generates a descriptor $Q_A$ on the basis of the input data $I_A$. Similarly, the generation sections $\mathbf{12}_B$ generates a descriptor $Q_B$ on the basis of the input data $I_B$. As shown in FIG. 4, the descriptor $Q_A$ includes an HPCP, spectral center of gravity, tone volume and degree of variation, while the descriptor $Q_B$ includes an LPF-HPCP, volume and degree of variation. The following lines explain an example manner in which character values of the descriptors $Q_A$ and $Q_B$ are determined on the basis of the input data $I_A$ and $I_B$.

In the case where the input data $I_A$ is event data, the generation section $\mathbf{12}_A$ generates an HPCP indicative of a combination of a tone designated by a note number of the input data $I_A$ and tone volume corresponding to velocity of the input data $I_A$. Further, the generation section $\mathbf{12}_A$ determines a spectral center of gravity on the basis of an average value of a plurality of note numbers (tone pitches) of the input data $I_A$ and determines a tone volume on the basis of velocity. Further, in the case where the input data $I_A$ is after-touch data, the generation section $\mathbf{12}_A$ determines a degree of variation on the basis of key depression pressure designated by the input data $I_A$. For example, the generation section $\mathbf{12}_A$ sets a degree of variation such that the degree increases as the key depression pressure value increases. In a similar manner to the generation section $\mathbf{12}_A$, the generation section $\mathbf{12}_B$ determines an LPF-HPCP and tone volume on the basis of the input data $I_B$ (event data) including a note number and velocity and determines a degree of variation on the basis of the input data $I_B$ (after-touch data) including key depression pressure.

The beat point data B output from the detector 64 is supplied not only to the data generation section 18 but also to the generation section $\mathbf{12}_C$ of the descriptor generation section 12 as input data $I_C$. As shown in FIGS. 3 and 4, the generation section $\mathbf{12}_C$ generates a descriptor $Q_C$ on the basis of the input data $I_C$. The descriptor $Q_C$ includes a temp. The generation section $\mathbf{12}_C$ determines, as a tempo, the number of beat points designated by the input data $I_C$ (beat point data B) within a unit time and includes the determined tempo in the descriptor $Q_C$.

As shown in FIGS. 1 and 3, the similarity calculation (determination) section 14 determines similarity between the descriptors Q ($Q_A$, $Q_B$, $Q_C$) generated by the descriptor generation section 12 and descriptor P of each fragment data $D_S$ in a candidate data group G; more particularly, the similarity calculation section 14 calculates similarity index values R ($R_A$, $R_B$) indicative of degrees of similarity between the generated descriptors Q ($Q_A$, $Q_B$, $Q_C$) and descriptor P of each fragment data $D_S$. As shown in FIG. 3, the similarity calculation section 14 includes calculation sections $\mathbf{14}_A$ and $\mathbf{14}_B$ and a setting section $\mathbf{14}_C$. The calculation section $\mathbf{14}_A$ calculates a similarity index value $R_A$ for each fragment data $D_S$ in the candidate data group G through comparison between the descriptors $Q_A$ and $Q_B$ and the descriptor P of each fragment data $D_S$. Similarly, the calculation section $\mathbf{14}_B$ calculates a similarity index value $R_B$ for each fragment data $D_S$ in the candidate data group G through comparison between the descriptors $Q_B$ and $Q_C$ and the descriptor P of each fragment data $D_S$. The setting section $\mathbf{14}_C$ shown in FIG. 3 sets a weighting value for each of the character values included in the descriptors P an Q. In the instant embodiment, the setting section $\mathbf{14}_C$ sets a weighting value for each of the character values in accordance with content of operation performed on the input device 40.

The calculation section $\mathbf{14}_A$ calculates a similarity index value $R_A$ on the basis of each character value weighted with the weighting value set by the setting section $\mathbf{14}_C$. For example, if N (N=5 in the illustrated example of FIG. 4) types of character values are included in the descriptors $Q_A$ and $Q_C$, the similarity index value $R_A$ can be calculated by $$R_A=\alpha_1\cdot\gamma_1+\alpha_2\cdot\gamma_2+\ldots+\alpha_N\cdot\gamma_N \quad (1),$$

where the degree of similarity $\gamma i$ (i is an integral number satisfying a condition "$1 \leqq i \leqq N$") is a numerical value indicative of a degree of similarity between an i-th character value included in the descriptors $Q_A$ and $Q_C$ and a character value, which is of the same type as the i-th character value, in the descriptor P. In the illustrated example of FIG. 4, degrees of similarity $\gamma_1$-$\gamma_5$ (N=5) are calculated between 1) four types of character values (i.e., HPCP, spectral center of gravity, tone volume and degree of variation) in (or belonging to) the descriptor $Q_A$ and one type of character value (i.e., tempo) in the descriptor $Q_C$ and 2) the same types (five types) of character values in the descriptor P. The degree of similarity $\gamma i$ is calculated on the basis of a predetermined mathematical expression such that it takes a greater value as the descriptors $Q_A$ and $Q_C$ and the descriptor P approximate each other more closely in character value. More specifically, the degree of similarity $\gamma i$ is an inverse number of a square of a difference between the character value in the descriptor $Q_A$ or $Q_C$ and the character value in the descriptor P.

Further, the weighting value $\alpha i$ in Mathematical Expression (1) above is a weighting value set by the setting section $\mathbf{14}_C$ for an i-th character value. As seen from Mathematical Expression (1), the similarity index value $R_A$ takes a greater value as the descriptors $Q_A$ and $Q_C$ and the descriptor P approximate each other more closely in character value. Also, the similarity index value $R_A$ takes a greater value as the descriptors $Q_A$ and $Q_C$ and the descriptor P approximate each other more closely in character value to which is assigned a great weighting value $\alpha i$.

The calculation section $\mathbf{14}_B$ calculates a similarity index value $R_B$ in a similar manner to the aforementioned. Namely, the similarity index value $R_B$ takes a greater value as individual character values of the descriptors $Q_A$ and $Q_C$ and the same types of character values of the descriptor P approximate each other, and it also takes a greater value as the descriptors $Q_A$ and $Q_C$ and the descriptor P approximate each other more closely in character value to which is assigned a great weighting value set by the weighting section $\mathbf{14}_C$.

The fragment selection section 16 of FIG. 1 selects one or more fragment data $D_S$ from the candidate data group G on the basis of the similarity index value R ($R_A$, $R_B$) calculated by the similarity calculation section 14 for each of the fragment, acquires the tone data M ($M_A$, $M_B$) of the fragment data $D_S$ from the storage device 30 and then outputs the acquired tone data to the data generation section 18. As shown in FIG. 3, the fragment selection section 16 includes selection sections $\mathbf{16}_A$ and $\mathbf{16}_B$. The selection section $\mathbf{16}_A$ selects, from the candidate data group G, a predetermined number of fragment data in decreasing order of the similarity index values $R_A$ calculated by the similarity calculation section 14, reads out the tone data M ($M_A$) of each of the selected fragment data $D_S$ from the storage device 30 and sequentially outputs the read-out tone data to the data generation section 18. Namely, the tone data $M_A$ of fragments similar in musical character to a performance executed by the user with respect to the higher-pitch section 621 of the electronic musical instrument 62 and detector 64 (i.e., fragments having a chord feeling or tone color feeling similar to content of the performance) are selectively output to the data generation section 18.

Similarly, the selection section $\mathbf{16}_B$ selects, from the candidate data group G, a predetermined number of fragment data $D_S$ in decreasing order of the similarity index values $R_B$, reads out the tone data M ($M_B$) of each of the selected fragment data $D_S$ from the storage device 30 and sequentially outputs the read-out music piece data to the data generation section 18. Thus, the tone data $M_B$ of fragments similar in musical character to a performance executed by the user with respect to the lower-pitch section 622 of the electronic musical instrument 62 and detector 64 are selectively output to the data generation section 18. Note that the tone data M ($M_A$, $M_B$) may be output to the data generation section 18 either in the increasing order of the similarity index values R ($R_A$, $R_B$) or in arranged order in the candidate data group G.

The data generation section 18 of FIG. 1 generates output data O on the basis of the tone data M ($M_A$, $M_B$) output from the fragment selection section 16. As shown in FIG. 3, the data generation section 18 in the instant embodiment includes processing sections $\mathbf{181}_A$ and $\mathbf{181}_B$, connecting sections $\mathbf{183}_A$ and $\mathbf{183}_B$, and an adder 185. The processing sections $\mathbf{181}_A$ processes the tone data $M_A$ supplied from the selection section $\mathbf{16}_A$ and sequentially outputs the processed tone data $M_A$. Similarly, the processing sections $\mathbf{181}_B$ processes the tone data $M_B$ supplied from the selection section $\mathbf{16}_B$ and sequentially outputs the processed tone data $M_B$. The following paragraphs describe details of the processing performed by the processing sections $\mathbf{181}_A$ and $\mathbf{181}_B$.

Figure 5:
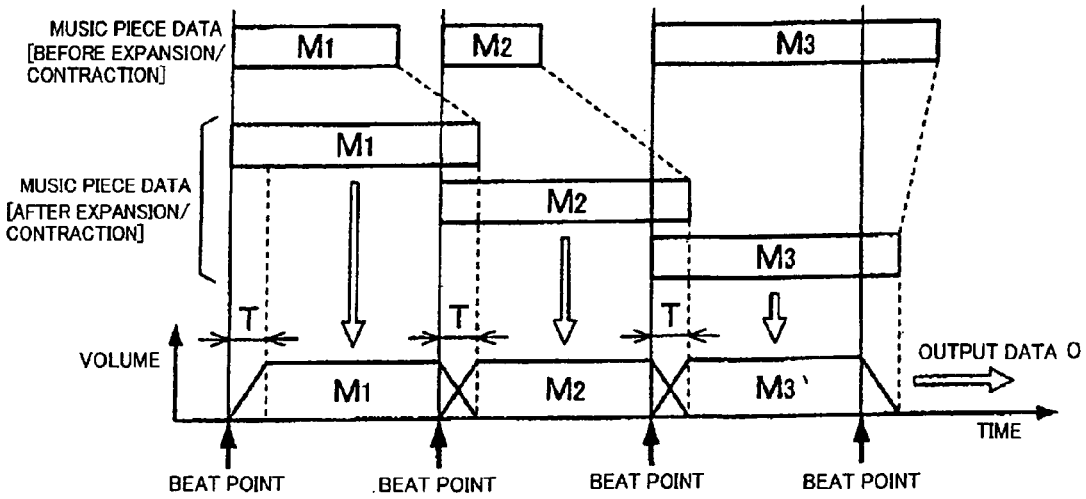
FIG. 5 is a time chart explanatory of processing performed by a data generation section.

FIG. 5 is a conceptual diagram explanatory of the processing performed by the data generation section 18. In the figure, each beat point designated by beat point data B is shown by an arrow on the time axis. Tones represented by tone data M ($M_1$-$M_3$) have different time lengths. The processing section $\mathbf{181}_A$ expands or contracts tone data $M_A$ so that the tone data $M_A$ has a time length corresponding to an interval between beat points designated by beat point data B supplied from the detector 64. Namely, in the illustrated example of FIG. 5, tone data $M_1$ and $M_2$, each having a time length greater than the interval between the beat points, are expanded, while tone data $M_3$ having a time length smaller than the interval between the beat points is contracted. Note that the tone data expansion/contraction may be effected using any of the various conventionally-known techniques for adjusting a tempo without involving a tone pitch change.

Further, the processing section $\mathbf{181}_A$ varies the pitch of the tone data $M_A$ in accordance with pitch-bend data PB supplied from the electronic musical instrument 62. Further, the processing section $\mathbf{181}_A$ performs tone volume adjustment and equalization on the tone data $M_A$ and then performs a filter process on the tone data $M_A$ for cutting off frequency components lower than a predetermined frequency (that is, for example, the frequency corresponding to the pitch of the dividing boundary point between the higher- and lower-pitch sections 621 and 622 of the electronic musical instrument 62). Similarly, the processing section $\mathbf{181}_B$ performs time length adjustment responsive to the beat point data B and pitch adjustment responsive to the pitch-bend data PB on the tone data $M_B$ and then performs a filter process on the tone data $M_B$ for cutting off frequency components lower than the predetermined frequency.

The connecting section $\mathbf{183}_A$ of FIG. 3 generates output data $O_A$ by interconnecting the individual tone data $M_A$ processed by the processing section $\mathbf{181}_A$. As shown in FIG. 5, the connecting section $\mathbf{183}_A$ interconnects the individual tone data $M_A$ so that reproduction of each of the tone data $M_A$ is started at the beat point indicated by the beat point data B and the successive or adjoining tone data $M_A$ overlap with each other in a cross-fading fashion; for example, from a start point to an end point of a time period T (e.g., about 20 msec) starting at the beat point, a trailing end portion of one tone data $M_1$ gradually decreases in tone volume while a leading end portion of another or succeeding tone data $M_2$ gradually increases in tone volume. With the aforementioned arrangement, the instant embodiment can generate natural tones with the individual tone data M interconnected smoothly.

In a similar manner to the connecting section $\mathbf{183}_A$, the connecting section $\mathbf{183}_B$ generates output data $O_B$ by interconnecting the individual tone data $M_B$ processed by the processing section $\mathbf{181}_B$. Adder section $\mathbf{183}_A$ adds together the output data $O_A$ generated by the connecting section $\mathbf{183}_A$ and output data $O_B$ generated by the connecting section $\mathbf{183}_B$, to thereby generate output data O. Tone is reproduced by the thus-generated output data O being supplied to the output device 50.

In the instant embodiment, as explained above, fragments (fragment data $D_S$) are selected in accordance with similarity index values R between the descriptors Q and P, and thus, there is no need to define in advance (correspondence) relationship between the input data I and the descriptors P. Further, because fragments closely related to content of a user's performance in terms of musical characters are selectively used for generation of output data O, the instant embodiment can reproduce tones appropriately reflecting therein an intension of the user's performance. Further, because the similarity index values R are calculated on the basis of character values weighted in accordance with user's instructions, the instant embodiment can generate a variety of tones preferentially reflecting therein a character value to which the user attaches particular importance.

In the instant embodiment, there are individually set the channel for generating higher-pitch-side output data $O_A$ and lower-pitch-side output data $O_B$, so that fragment data $D_S$ of different music pieces can be selected on the higher-pitch side and lower-pitch side. In this way, the instant embodiment can generate a variety of tones with melody tones (of higher pitches) and bass tones (of lower pitches) clearly differentiated.

Tone data M are sequentially reproduced in synchronism with beat points designated by beat point data B. Thus, the user can set a desired tempo of tones by controlling a cyclic period of his or her body motion. Further, because tone data M is generated for each fragment obtained by segmenting a music piece on a beat-by-beat basis and because the tone data M is adjusted by the data generation section 18 to have a time length synchronous with the beat point designated by the beat point data B, the instant embodiment can generate tones that progress naturally with a unified rhythm feeling.

Only one or more fragment data $D_S$, extracted as a candidate data group G from among all of the fragment data $D_S$ stored in the storage device 30, are used for generation of output data O. Thus, the above-described embodiment is advantageous in that processing loads on the control device 10 (e.g., the load involved when the similarity calculation section 14 calculates a similarity index value R and the load involved when the fragment selection section 16 selects a fragment) can be reduced as compared to the conventional construction where all of fragment data $D_S$ are processed. Further, because fragment data $D_S$ satisfying user-designated conditions are extracted as a candidate data group G, the above-described embodiment can advantageously generate tones conforming to a user's intention.

B. Modification

The above-described invention may be modified variously, and the following paragraphs describe specific examples of modifications; note that the following modifications may be combined as necessary.

(1) Modification 1:

Character values included in the descriptors P and Q are not limited to the aforementioned. For example, the descriptors P may include pitches of tones included in corresponding fragments of a music piece, and the descriptors Q may include pitches of tones corresponding to note numbers of input data I (event data). Tone data M of a fragment including a pitch similar to that of a key operated by the user on the electronic musical instrument 62 is used for generation of output data O.

Further, a numerical value indicative of a degree of tone color complexity (hereinafter referred to simply as "degree of complexity") of tones within a fragment may be included in the descriptor P. For example, the more the number of types of tones in the fragment, the greater value the degree of complexity takes. The descriptor Q generated on the basis of the input data I too includes such a degree of complexity. The descriptor generation section 12 calculates the degree of complexity of the descriptor Q such that the degree of complexity takes a greater value if a range of tone pitches designated by note numbers of input data I is greater (i.e., value of a difference between the highest-pitch tone and the lowest-pitch tone is greater). As seen from the foregoing, the descriptor P only has to include at least one character value indicative of a musical character of a tone within a fragment, while the descriptor Q only has to include at least one character value indicative of a musical character of a performance executed by the user.

(2) Modification 2:

Whereas the foregoing have described the construction where the time length of tone data M is adjusted to synchronize with a beat point designated by beat point data B, it is not necessarily necessary to expand or contract tone data M. For example, there may be employed an alternative construction where tone data M are arranged in synchronism with beat points or in succession (without being necessarily synchronized with beat points) regardless of excess/deficiency of the time length. Further, in the case where tone data M are expanded or contracted too, specific contents of the processing may be modified as necessary. For example, the time length (tempo) of tone data M may be adjusted in such a manner that the tone pitch too is changed with the adjusted time length (tempo), or the time length (tempo) of tone data M may be adjusted by interpolating, as necessary, a waveform of a particular tone included in tone data M. If tone data M are reproduced for a time period, shorter than the beat-to-beat interval, from a particular beat point, rhythmical tones, rich in auditory interest or attractiveness, can be generated because a silent section is set to an interval between beat points.

(3) Modification 3:

Whereas the foregoing have described the construction where a predetermined number of fragment data $D_S$ are selected in decreasing order of similarity index values R, the way of selecting fragment data $D_S$ may be modified as necessary. For example, fragment data $D_S$ of which the similarity index value R exceeds a predetermined threshold value may be selected, or only one fragment data $D_S$ of which the similarity index value R is the greatest may be selected. In another alternative, there may be employed a construction where fragment data $D_S$ that can be candidates of selection by the fragment selection section 16 are not narrowed down to a candidate data group G; namely, the similarity index value calculation and selection by the fragment selection section 16 may be performed for every fragment data $D_S$ stored in the storage device 30.

(4) Modification 4:

Whereas the foregoing have described the construction where output data O is generated in accordance with positional arrangement of individual tone data M, the way of generating output data O may be chosen as desired without being limited to the aforementioned example. For example, output data O may be generated by mixing a plurality of tone data, selected by the fragment selection section 16, at a predetermined ratio. Further, the pitch of a tone indicated by tone data M may be converted into a pitch of a note number included in input data I ($I_A$, $I_B$) and then used for generation of output data O.

(5) Modification 5:

Character value determined on the basis of after-touch data (key depression pressure) is not limited to one indicative of a degree of variation. For example, a time length of a fragment, corresponding to after-touch data, may be determined by the descriptor generation section 12 (12A, 12B) as a character value. More specifically, the greater the pressure designated by after-touch data, the shorter the time lengths of fragments included as character values in the descriptors Q ($Q_A$, $Q_B$). On the other hand, time lengths of individual fragments of a music piece are included in the descriptors P. With such an arrangement, a fragment of a time length corresponding to after-touch data is selected by the fragment selection section 16. Thus, if, for example, the user depresses more other keys after depression of a particular key on the electronic musical instrument 62, a fragment of a shorter time length is selected; in this way, it is possible to reproduce a music piece where frequent changes occur in tone and tune at short intervals.

Further, a numerical value functioning as an index indicative of a degree of tone color variation (e.g., amount or frequency of tone color variation) within a fragment may be included in the descriptor P so that the descriptor generation section 12 can determine, as a character value, a degree of tone color variation corresponding to after-touch data. For example, the descriptor generation section 12 may determine a degree of tone color variation such that the variation degree increases if a greater pressure is designated by after-touch data. With such an arrangement, it is possible to reproduce a music piece where greater tone color variation occurs if the user depresses more other keys after depression of a particular key on the electronic musical instrument 62 (e.g., where tone color changes frequently).

Furthermore, the number of fragments to be reproduced simultaneously (i.e., in parallel) may be controlled in accordance with after-touch data. For example, the data generation section 18 generates output data O by mixing a particular number of tone data M, corresponding to after-touch data (input data $I_A$, $I_B$) output from the electronic musical instrument 62, from among tone data M of a plurality of fragments selected by the fragment selection section 16. With such an arrangement, a greater number of fragments can be reproduced simultaneously if the user depresses more other keys after depression of a particular key on the electronic musical instrument 62.

Whereas the foregoing have described after-touch data indicative of intensity of key depression, an input to an assignable controller, such as a pitch-bend wheel or modulation wheel, may be used in place of the after-touch data.

(6) Modification 6:

The way of calculating the similarity index value R may be chosen as desired without being limited to the aforementioned. For example, whereas the similarity index value R has been described as increasing as similarity in character value between the descriptors P and Q increases (Mathematical Expression (1)), the similarity index value R may be a value decreasing as similarity in character value between the descriptors P and Q increases. Further, weighting by the setting section $\mathbf{14}_C$ may be dispensed with. For example, coordinates corresponding to the descriptors P and Q may be set in an N-dimensional space, and a distance between such coordinates (or inverse number of the distance) may be calculated as the similarity index value R.

(7) Modification 7:

Whereas the foregoing have described the construction where the control device 10 executes a software program to generate the output data O, the tone processing apparatus 100 may be implemented by hardware (electronic circuit), such as a DSP, that performs processing similar to that performed by the control device 10 of FIG. 1.

This application is based on, and claims priority to, JP PA 2007-001058 filed on 9 Jan. 2007. The disclosure of the priority application, in its entirety, including the drawings, claims, and the specification thereof, is incorporated herein by reference.

What is claimed is:

1. A tone processing apparatus comprising:

a storage section that, for at least one music piece, stores tone data of each of a plurality of fragments segmented from the music piece and stores a first descriptor indicative of a musical character of each of the fragments in association with the fragment;

a descriptor generation section that receives input data based on operation by a user and generates a second descriptor, indicative of a musical character, on the basis of the received input data;

a determination section that determines similarity between said second descriptor and said first descriptor of each of the fragments;

a selection section that selects the tone data of at least one of the fragments from the storage section on the basis of a result of similarity determination by said determination section; and a data generation section that, on the basis of the tone data of the fragment selected by said selection section, generates tone data to be outputted, wherein said determination section calculates a similarity index value indicative of a degree of similarity, to said second descriptor, of said first descriptor of each of the fragments, and said selection section selects, from said storage section, the tone data of at least one of the fragments on the basis of the similarity index value calculated by said determination section.

2. The tone processing apparatus as claimed in claim 1 wherein said descriptor generation section receives input data from a performance device that generates the input data in response to performance operation by the user.

3. The tone processing apparatus as claimed in claim 2 wherein said first descriptor includes a combination of information indicative of a pitch of a tone included in the fragment associated therewith and information indicative of a volume of the tone, said input data includes operator data indicative of a performance operator member operated by the user on the performance device and intensity data indicative of intensity of operation, by the user, of the performance operator member, and said descriptor generation section generates said second descriptor that includes a combination of information indicative of a pitch corresponding to the operator data and information indicative of a volume corresponding to the intensity data.

4. The tone processing apparatus as claimed in claim 2 wherein said first descriptor includes information indicative of a volume of a tone included in the fragment associated therewith, said input data includes intensity data indicative of intensity of operation, by the user, of a performance operator member of the performance device, and said descriptor generation section generates said second descriptor that includes information indicative of a volume corresponding to the intensity data.

5. The tone processing apparatus as claimed in claim 1 wherein said first descriptor includes information indicative of a spectral center of gravity of a chord included in the fragment associated therewith, and said descriptor generation section determines a chord on the basis of the input data, determines a spectral center of gravity of the determined chord and generates said second descriptor including information indicative of the determined spectral center of gravity of the determined chord.

6. The tone processing apparatus as claimed in claim 2 wherein said first descriptor includes information indicative of a degree of variation of a tone within the fragment associated therewith, said input data includes after-touch data indicative of a sustained operating state of a performance operator member of the performance device following operational triggering, by the user, of the performance operator member, and said descriptor generation section generates said second descriptor that includes degree-of-variation information corresponding to the after-touch data.

7. The tone processing apparatus as claimed in claim 1 wherein said first descriptor includes information indicative of a tempo in the fragment associated therewith, said input data includes beat point data indicative of a beat point synchronous with an input motion of the user, and said descriptor generation section generates said second descriptor that includes information indicative of a tempo corresponding to the beat point indicated by the beat point data.

8. The tone processing apparatus as claimed in claim 1 wherein said input data includes beat point data indicative of a beat point synchronous with an input motion of the user, and said data generation section includes a connecting section that time-serially arranges the tone data of each of the fragments, sequentially selected by said selection section, in such a manner that the tone data synchronizes with the beat point indicated by the beat point data.

9. The tone processing apparatus as claimed in claim 8 wherein said data generation section further includes a processing section that processes a respective time length of the tone data of each of the fragments, sequentially selected by said selection section, in such a manner that the tone data has a time length corresponding to a time interval between the beat points indicated by the beat point data.

10. The tone processing apparatus as claimed in claim 1 wherein said first descriptor and said second descriptor each include a character value of each of a plurality of types of musical character elements, and which further comprises a setting section that sets weighting, as desired by the user, individually for each of the plurality of types of musical character elements, said determination section using a character value, weighted for each of the musical character elements, to determine similarity between said second descriptor and said first descriptor of each of the musical character elements.

11. The tone processing apparatus as claimed in claim 1 wherein said data generation section outputs, as the tone data to be outputted, the tone data of the at least one fragment selected by said selection section.

12. The tone processing apparatus as claimed in claim 1 wherein said data generation section generates the tone data to be outputted, by mixing the tone data of a plurality of fragments selected by said selection section.

13. The tone processing apparatus as claimed in claim 1 wherein said first descriptor includes information indicative of a degree of complexity of a tone color of a tone included in the fragment associated therewith, and said descriptor generation section generates, on the basis of tone-generation instructing information included in the input data, said second descriptor that includes information indicative of a degree of complexity of a tone color.

14. The tone processing apparatus as claimed in claim 2 wherein said input data includes after-touch data indicative of a sustained operating state of a performance operator member of the performance device following operational triggering, by the user, of the performance operator, and said data generation section generates the tone data to be outputted, by mixing a particular number of tone data, corresponding to a value of the after-touch data, of the tone data of the at least one fragment selected by said fragment selection section.

15. The tone processing apparatus as claimed in claim 1 wherein said first descriptor and said second descriptor each include a character value of each of a plurality of types of musical character elements, and said determination section determines, on the basis of respective character values of a plurality of types of the musical character elements, similarity between said second descriptor and said first descriptor of each of the musical character elements.

16. The tone processing apparatus as claimed in claim 1 which comprises a plurality of processing channels each including said descriptor generation section, said determination section, said selection section and said data generation section, said processing channels corresponding to a plurality of ranges, and wherein the input data generated in response to performance operation, by the user, in each of the ranges of the performance device is input to said descriptor generation section of the processing channel corresponding to the range.

17. The tone processing apparatus as claimed in claim 16 wherein, for a plurality of music pieces, said storage section has stored therein the tone data and the first descriptor of each of the fragments, and the tone data and the first descriptor of each of the fragments for a same music piece are used in each different one of the processing channels.

18. The tone processing apparatus as claimed in claim 16 wherein, for a plurality of music pieces, said storage section has stored therein the tone data and the first descriptor of each of the fragments, and the tone data and the first descriptor of each of the fragments for different music pieces are used in each different one of the processing channels.

19. A method for processing a tone by use of a storage section that, for at least one music piece, stores tone data of each of a plurality of fragments segmented from the music piece and stores a first descriptor indicative of a musical character of each of the fragments in association with the fragment, said method comprising:

a step of receiving input data based on operation by a user and generating a second descriptor, indicative of a musical character, on the basis of the received input data;

a determination step of determining similarity between said second descriptor and said first descriptor of each of the fragments, the determination step calculating a similarity index value indicative of a degree of similarity, to said second descriptor, of said first descriptor of each of the fragments;

a selection step of selecting the tone data of at least one of the fragments from the storage section on the basis of a result of similarity determination by said determination step, the selection step selecting, from said storage section, the tone data of at least one of the fragments on the basis of the similarity index value calculated by the determination step; and a step of, on the basis of the tone data of the at least one fragment, generating tone data to be outputted.

20. A computer-readable storage medium containing a program for causing a computer to perform a tone processing procedure by use of a storage section that, for at least one music piece, stores tone data of each of a plurality of fragments segmented from the music piece and stores a first descriptor indicative of a musical character of each of the fragments in association with the fragment, said tone processing procedure comprising:

a step of receiving input data based on operation by a user and generating a second descriptor, indicative of a musical character, on the basis of the received input data;

a determination step of determining similarity between said second descriptor and said first descriptor of each of the fragments, the determination step calculating a similarity index value indicative of a degree of similarity, to said second descriptor, of said first descriptor of each of the fragments;

a selection step of selecting the tone data of at least one of the fragments from the storage section on the basis of a result of similarity determination by said determination step, the selection step selecting, from said storage section, the tone data of at least one of the fragments on the basis of the similarity index value calculated by the determination step; and a step of, on the basis of the tone data of the at least one fragment, generating tone data to be outputted.

* * * * *